US008282742B2

(12) United States Patent
Schoenberger et al.

(10) Patent No.: US 8,282,742 B2
(45) Date of Patent: Oct. 9, 2012

(54) PORTABLE INDUSTRIAL VACUUM SYSTEM

(75) Inventors: Stephen B Schoenberger, Northbrook, IL (US); Robert M Reavis, Rochester, WI (US)

(73) Assignee: Vector Technologies, Milwaukee, WI (US)

( * ) Notice: Subject to any disclaimer, the term of this patent is extended or adjusted under 35 U.S.C. 154(b) by 466 days.

(21) Appl. No.: 12/610,580

(22) Filed: Nov. 2, 2009

(65) Prior Publication Data

US 2010/0108099 A1 May 6, 2010

Related U.S. Application Data

(60) Provisional application No. 61/110,000, filed on Oct. 31, 2008.

(51) Int. Cl.
*B08B 5/04* (2006.01)

(52) U.S. Cl. ..... 134/21; 134/18; 134/42; 15/306.1; 15/309.2; 280/33.991; 280/401; 280/402; 280/639; 55/356; 55/422; 55/429

(58) Field of Classification Search ..... 134/18, 134/21, 42; 15/300.1, 306.1, 309.2, 319; 55/356, 422, 429; 280/33.991, 401, 402, 280/639

See application file for complete search history.

(56) References Cited

U.S. PATENT DOCUMENTS 4,121,915 A * 10/1978 Anderson ..... 96/245
4,574,420 A * 3/1986 Dupre ..... 15/331

* cited by examiner

*Primary Examiner* — Saeed T Chaudhry
(74) *Attorney, Agent, or Firm* — SNR Denton US LLP

(57) ABSTRACT

An industrial vacuum system which is contained in a portable container having a bottom and an open end and includes an extension unit having a first end operatively connected to the portable container and a second end that is selectively extendable away from the container, a collection unit rotatively coupled to first ends of the extension unit, a transportation unit coupling the extension unit to the container, the transportation unit having one end rotatively coupled to the end of the extension unit the transportation unit including a plurality of wheel units, and a trolley guidance unit having a rail attached to the bottom of the container and engaging the wheels of the wheel unit. Where the collection unit and extension unit completely move into the portable container via the transportation unit, the rails of the trolley guidance unit include a shelf having an upper surface and a lower surface, and the wheel units include at least two upper wheels in contact with the upper surface of the transportation guide unit and at least two lower wheels in contact with the lower surface of the shelf.

18 Claims, 5 Drawing Sheets

PORTABLE INDUSTRIAL VACUUM SYSTEM

CROSS-REFERENCE TO RELATED APPLICATIONS

This application claims the benefit of the filing date of U.S. Provisional Application No. 61/110,000," filed on Oct. 31, 2008, which is incorporated herein by reference to the extent permitted by law

FIELD OF THE INVENTION

This invention deals with industrial vacuum systems. In particular, this invention deals with large portable industrial vacuum systems, which are capable of being stored in a single high-cube container.

BACKGROUND OF THE INVENTION

A conventional industrial vacuum system may be attached to the back of a vehicle and driven to locations where the industrial vacuum is needed. In a conventional industrial vacuum system, the collection unit is typically raised above a dump truck, tote or other disposal vessel and an operator collects the material using a hose connected to the vacuum unit. However, the collection unit of conventional industrial vacuum systems is only capable of being raised approximately eight feet, nine inches, which limits its use.

In addition, many times it is not possible to drive an industrial vacuum system to a remote location because roadways do not go where the material resides. For example, when the material to be collected is in a very remote location such as a mountain railroad pass, the transportation and use of a conventional industrial vacuum system is impractical. Further, in many instances the conventional industrial vacuum system must be raised higher than eight feet, nine inches to accommodate taller collection and disposal vessels. Conventional industrial vacuum systems do not provide an adequate method of transporting the vacuum to remote areas.

Furthermore, at times large vacuum systems are shipped to remote locations via freight ships. Conventional industrial vacuums cannot be loaded into a standard high-cube container. To circumvent this problem, the industrial vacuum system can be disassembled and shipped in a sea container. However, this solution requires, the industrial vacuum systems to be reassembled in the remote location, which can prove to be a difficult and time consuming task. Alternatively, conventional large industrial vacuum systems can be shipped outside a sea container as on or below deck "break-bulk," which creates problems of corrosion due to salt water exposure and theft because the components are not secured. Further, when goods are not shipped in a sea container, the cost of shipment is substantially more due to the additional storage space consumed and the added costs involved in physically loading and handling the system.

Accordingly, a need exists for an industrial vacuum system, which can be transported via rail, sea freight, helicopter, or plane to a remote location to collect material. A need also exists for an industrial vacuum system, which is capable of being easily removed from a container and placed back into the container with minimal effort. In addition, a need exists for an industrial vacuum system with a collection unit this is capable of being raised higher than eight feet, nine inches to allow for more efficient collection of material.

SUMMARY OF THE INVENTION

The present invention corrects the deficiencies in the earlier systems by providing a fully portable vacuum system, which does not require disassembly to transport. The system includes the following embodiments.

An industrial vacuum system, comprising a portable container having a bottom and an open end, an extension unit having a first end operatively connected to the portable container and a second end that is selectively extendable away from the container, a collection unit rotatively coupled to first ends of the extension unit, a transportation unit coupling the extension unit to the container, the transportation unit having one end rotatively coupled to the end of the extension unit the transportation unit including a plurality of wheel units, and a trolley guidance unit having a rail attached to the bottom of the container and engaging the wheels of the wheel unit. Where the collection unit and extension unit completely move into the portable container via the transportation unit, the rails of the trolley guidance unit include a shelf having an upper surface and a lower surface, and the wheel units include at least two upper wheels in contact with the upper surface of the transportation guide unit and at least two lower wheels in contact with the lower surface of the shelf.

In another embodiment consistent with the present invention, the extension unit includes at least one first extension arm rotatively coupled to at least one second extension arm which is rotatively coupled to the transportation unit, at least one upper guide arm and at least one lower guide arm rotatively coupled to the transportation unit, and at least one extension power unit rotatively coupled to at least one of the second extension arms and the transportation unit.

The transportation unit is engaged to the trolley guidance units such that the transportation unit is configured to travel a predetermined distance along the trolley guidance units causing the extension unit and collection unit to move in and out of the open end of the portable container by the transportation guide unit.

In another embodiment consistent with the present invention, the extension unit raises the collector unit to a height of 9 feet 7 inches or higher.

In yet another embodiment consistent with the present invention, the transportation guidance corresponds to an I shaped beam.

In another embodiment consistent with the present invention, the vacuum system includes a vacuum generation unit hydronically coupled to the collection unit, which is configured to supply a negative pressure to the inside of the collection unit.

In another embodiment consistent with the present invention, each of the wheel units include four upper wheels in contact with the upper surface of the shelf of the transportation guidance unit and four lower wheels in contact with the lower surface of the shelf of the transportation guidance unit.

In yet another embodiment consistent with the present invention, the vacuum unit includes a power extension unit having a first end rotatively coupled to the extension unit and having a second end rotatively coupled to the transportation unit and which is capable of rising the collection unit.

In yet another embodiment consistent with the present invention, the power extension unit and lower guide unit are rotatively connected to a base plate on the lower portion of the transportation unit, and the upper guidance arm and second extension arm are rotatively coupled to a pivot arm unit on the upper portion of the transportation unit.

Another embodiment consistent with the present invention presents a method of operating an industrial vacuum system including the steps of moving a transportation unit out of a container, the transportation unit including a plurality of wheel units which engage a trolley guidance unit which a rail attached to the bottom of the container, extending an extension unit having a first end operatively connected to the portable container and a second end that is selectively extendable away from the container, collecting a material using a collection unit rotatively coupled to first ends of the extension unit, where the collection unit and extension unit completely move into the portable container via the transportation unit, the rails of the trolley guidance unit include a shelf having an upper surface and a lower surface, and the wheel units include at least two upper wheels in contact with the upper surface of the transportation guide unit and at least two lower wheels in contact with the lower surface of the shelf.

In another embodiment consistent with the present invention, the extension unit includes at least one first extension arm rotatively coupled to at least one second extension arm which is rotatively coupled to the transportation unit, at least one upper guide arm and at least one lower guide arm rotatively coupled to the transportation unit, and at least one extension power unit rotatively coupled to at least one of the second extension arms and the transportation unit.

In another embodiment consistent with the present invention, the transportation unit is engaged to the trolley guidance units such that the transportation unit is configured to travel a predetermined distance along the trolley guidance units causing the extension unit and collection unit to move in and out of the open end of the portable container by the transportation guide unit.

In another embodiment consistent with the present invention, the extension unit raises the collector unit to a height of 9 feet 7 inches or higher.

In another embodiment consistent with the present invention, the transportation guidance corresponds to an I shaped beam.

In another embodiment consistent with the present invention, the method includes the step of generating vacuum via a vacuum generation unit hydronically coupled to the collection unit which is configured to supply a negative pressure to the inside of the collection unit.

In another embodiment consistent with the present invention, each of the wheel units include four upper wheels in contact with the upper surface of the shelf of the transportation guidance unit and four lower wheels in contact with the lower surface of the shelf of the transportation guidance unit.

In another embodiment consistent with the present invention, each of the wheel units include four upper wheels in contact with the upper surface of the transportation guidance unit and four lower wheels in contact with the lower surface of the transportation guidance unit. In another embodiment consistent with the present invention, the method including the step of extending the extension unit using a power extension unit having a first end rotatively coupled to the extension unit and having a second end rotatively coupled to the transportation unit and which is capable of rising the collection unit.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Figure 1A:
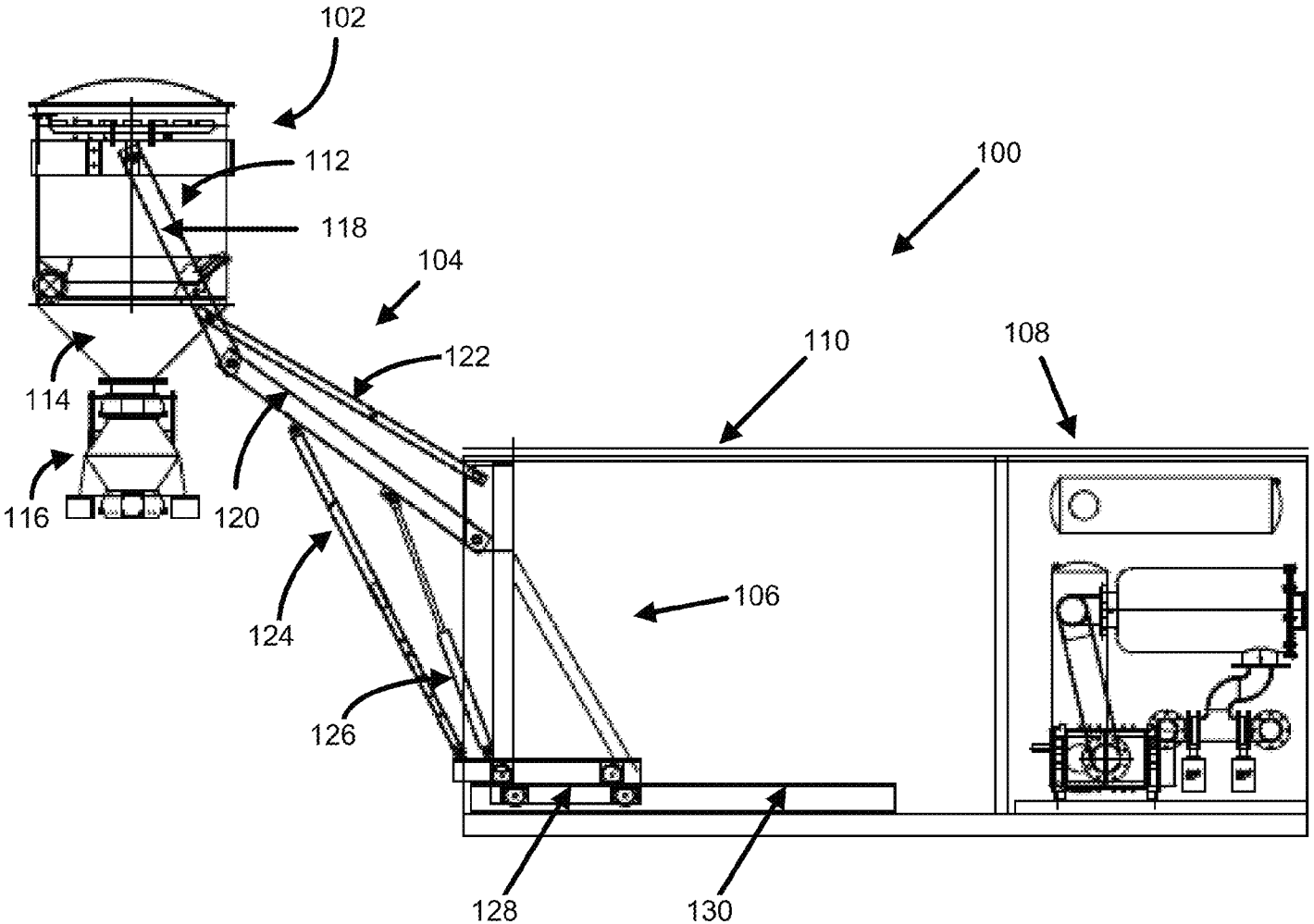
FIG. 1A depicts an exemplary mobile vacuum system consistent with the present invention.

Referring now to the drawings, which depict different embodiments consistent with the present invention. Wherever possible, the same reference numbers are used throughout the drawings and the following description to refer to the same or like parts.

FIG. 1A depicts a mobile vacuum system 100 in accordance with the present invention. The mobile vacuum system 100 includes a collection unit 102, an extension unit 104, a transportation unit 106, a vacuum generation unit 108, and a portable container 110. The collection unit 102 is pivotally connected to one end ("the second end") of the extension unit 104 via a plurality of movable arms that selectively extend away from the container 110. Another end of the extension unit 104 is pivotally connected to the transportation unit 106, which is configured to move the collection unit 102 and the extension unit 104 into the portable container 110. The vacuum generation unit 108 includes a power generation unit, which is used to provide power to extend and contract the extension unit 104 and to provide negative suction to the collection unit 102.

Continuing with FIG. 1A, the collection unit 102 includes a vacuum canister 112, a conical reception unit 114 operatively connected to the vacuum canister 112 and a vacuum inlet 116. The vacuum canister 112 is suctionally coupled to the vacuum generation unit 108 via a flexible connector (not shown in figures) coupled to the reception unit 114 including, but not limited to a hose, which is configured to provide a negative pressure inside the canister 112 such that debris is sucked into the canister 112. In one embodiment of the present invention, the vacuum inlet 116 is removabaly attached to the conical reception unit 114.

In one implementation, the vacuum generation unit 108 is a 350 horsepower, or larger, vacuum generation unit capable of producing a large negative pressure in the vacuum canister 112. The vacuum canister unit 112 may include a filter to remove airborne contaminants and water jets, which further reduce the production of dust and debris. The filter may be a conventional air filter or a high efficiency filter including, but not limited to a high efficiency particulate air ("HEPA") filter.

Continuing with FIG. 1A, the extension unit 104 includes at least two first extension arms 118, at least two second extension arms 120, at least two upper guidance arms 122, at least two lower guidance arms 124 and at least two extension power units 126. The first extension arms 118 are parallel to one another. Each of the first extension arms has a first end that is pivotally connected to the vacuum canister 112 and a second end that is pivotally attached to an end of the respective second extension arm 120. The first end of the first extension arm 118 defines the first end of the extension unit 104 that selectively extends away from the container 110. The second extension arms 120 are also parallel to one another. Each of the second extension arms 120 have one end that is pivotally connected to the second end of a respective first extension arm 118 and another end pivotally connected to the transportation unit 106. The upper guidance arms 122 are also parallel to one another. Each upper guidance arm 122 has one end that is pivotally coupled near the second end of the respective first extension arm 118 to guide the rotation of the first extension arm 118 about the respective second extension arm 120. Each upper guidance arm 122 has another end pivotally coupled to an upper portion of the transportation unit 106. Additionally, the lower guidance arms are pivotally coupled to the second extension arms 120 and the transportation unit 106. Finally, the extension power units 126 are parallel to one another and are pivotally connected to the second extension arm 120 and the transportation unit 106. The extension and guidance arms 118 and 120 are manufactured using a rigid material capable of supporting the weight of the collection unit, including, but not limited to, steel, aluminum, or other rigid material.

Figure 1B:
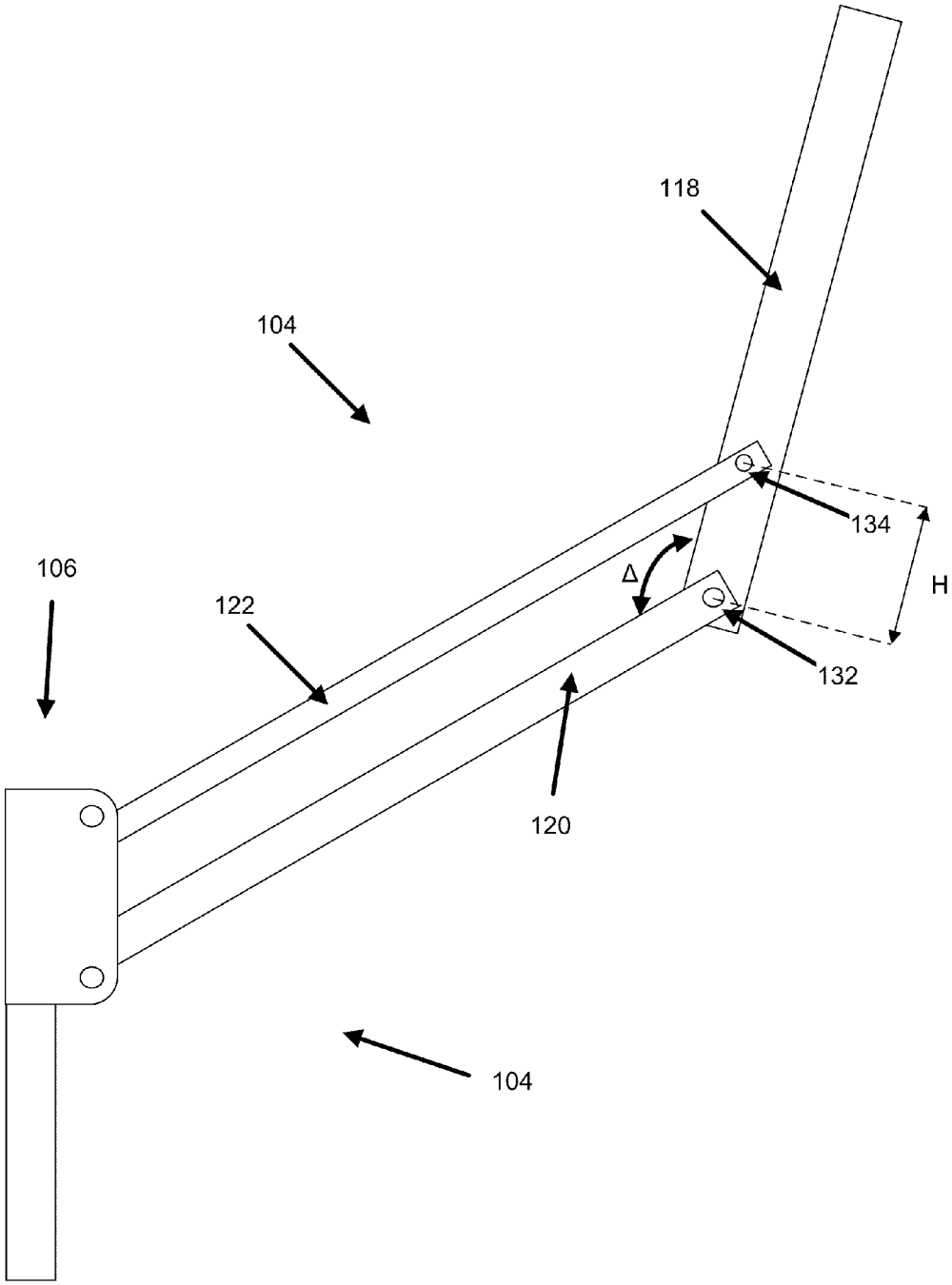
FIG. 1B depicts a side view of an exemplary extension unit of the vacuum system.

FIG. 1B depicts the side view of one implementation of the extension unit 104 connection to the transportation unit 106. The first extension arm 118 connects to the second extension arm 120 at a first rotational connection point 132 and connects to the upper guidance arm 122 at a second rotational connection point 134. The first rotational connection point 132 and second rotational connection point 134 is separated by a predetermined distance H. As FIG. 1B demonstrates, adjusting the distance H determines the angle of inclination (delta) between the two extension arms. The angle of inclination of the between the first extension arm 118 and second extension arm 120 adjusts the height of the collection unit 102 when the extension arms 118 and 120 are fully extended.

Figure 2A:
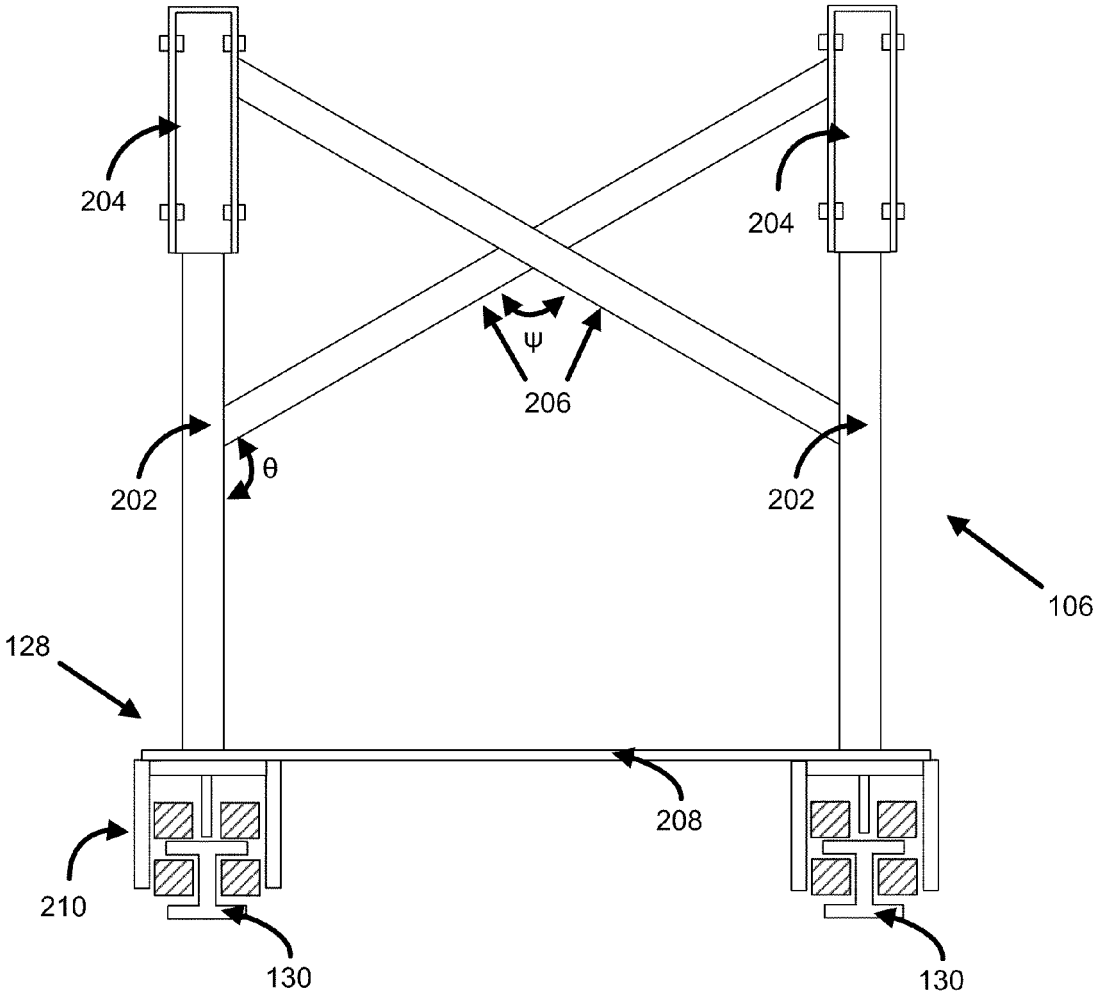
FIG. 2A depicts a front view of an exemplary transportation unit of the vacuum system consistent with the present invention.

Turning to FIG. 2A, a front view of one implementation of the transportation unit 106 consistent with the present invention is shown. The transportation unit 106 includes a trolley unit 128, at least one trolley guidance unit 130, at least two vertical support members 202, at least two arm pivot units 204 and at least two cross arm support members 206. The trolley unit 128 includes a base plate 208 and at least four-wheel units 210 that ride along the guidance units 130 as described in further detail herein.

The cross arm support members 206 connect to the two vertical support members 202 such that the vertical support members 202 are maintained perpendicular to the base plate 208 and provide horizontal support to the trolley unit 128. In one embodiment consistent with the present invention, the angle between a cross arm support member 206 and a vertical support member (theta) 202 is approximately 124 degrees. Further, the angle created by the two intersecting cross arm support members 206 (psi) is approximately 111 degrees. By adjusting the angle created by the two intersecting cross arm members, the horizontal support of the trolley unit 128 is increased resulting in a more compact design, which allows the trolley unit 128 to fit into a small container.

Figure 2B:
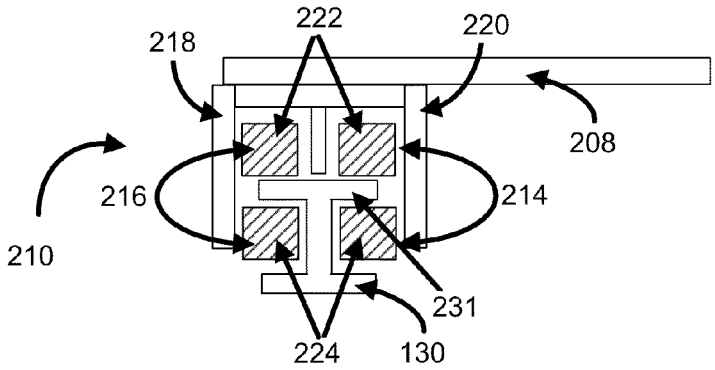
FIG. 2B depicts a front view of one of a plurality of wheel units of the transportation unit consistent with the present invention.

FIG. 2B shows a front view of one of the wheel units 210 consistent with the present invention. Each of the wheel units 210 includes a plurality of wheels grouped into an inner set of wheels 214 and an outer set of wheels 216. The outer set of wheels 216 are rotatively coupled to an outer wheel plate 218 and the inner set of wheels 214 are rotatively coupled to an inner wheel plate 220. In one embodiment consistent with the present invention, each wheel unit 210 has eight wheels 211 with four wheels 211 located above a respective trolley guidance unit 130 and four wheels 211 located below the trolley guidance unit 130.

In one implementation shown in FIGS. 2A and 2B, each trolley guidance unit 130 corresponds to an I-beam shaped rails having a shelf 231 with a top surface and a bottom surface. The lower wheels 222 of each wheel unit are in contact with the lower surface of the shelf 231 of a respective trolley guidance unit 130, and the upper wheels 224 of each wheel unit are in contact with the upper surface of the same shelf 231. Each of the two trolley guidance units 130 or rails is secured to the bottom of the container 110. In an alternate embodiment consistent with the present invention, each trolley guidance unit 130 may comprise a T-shaped beam in which the shelf 231 is affixed orthongally to a post or column that is affixed to the bottom of the container 110.

Figure 2C:
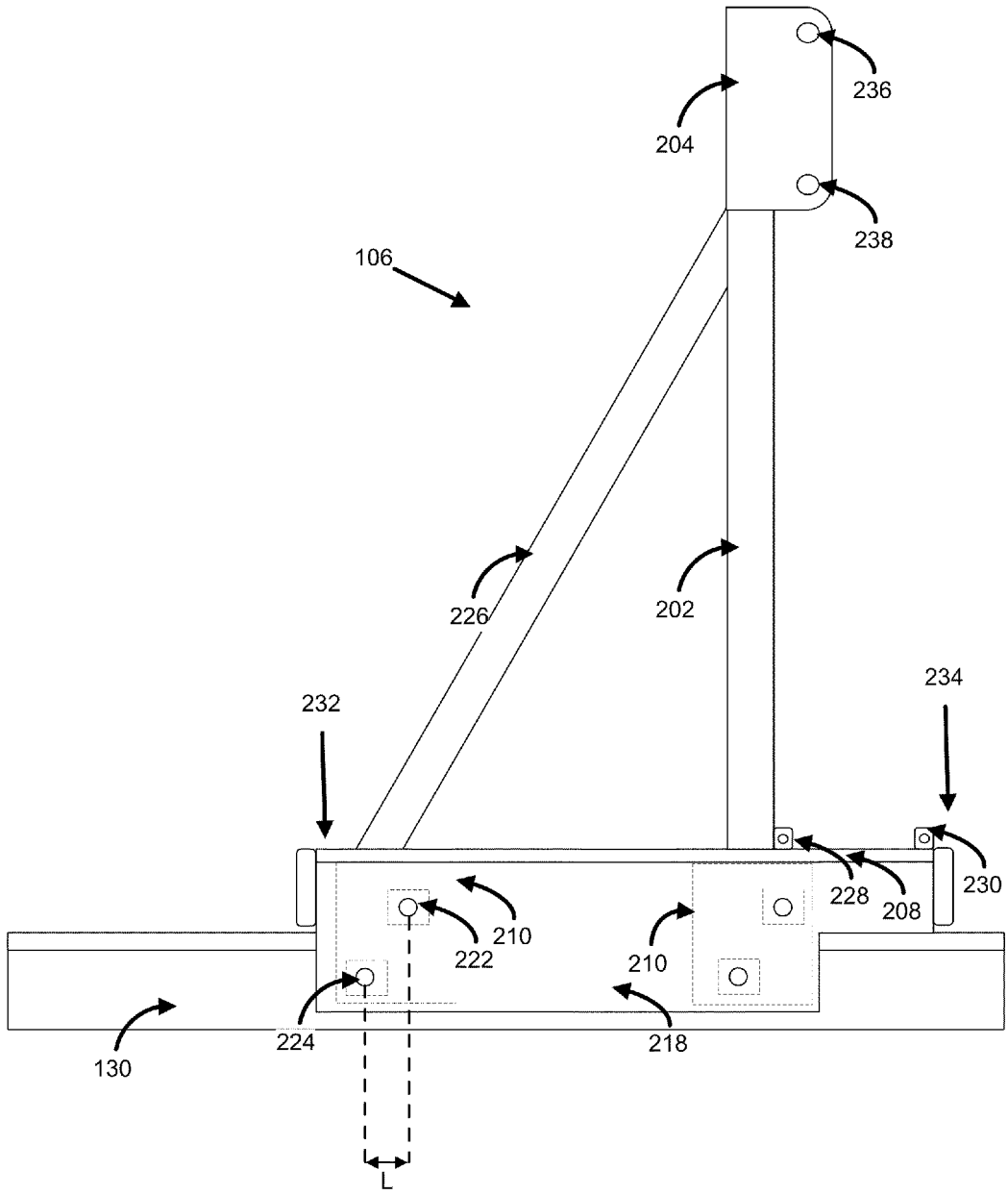
FIG. 2C depicts a side view of the transportation system of FIG. 2A.

FIG. 2C shows a side view of the transportation system 106 consistent with the present invention. The trolley unit 128 includes at least two angled support members 226, which has one end coupled to a respective vertical support member 202 and a second end coupled to a front end 234 of the base plate 208 of the trolley unit 128. The angled support members 226 serve to redistribute the forces exerted on the trolley unit 128 when the collection unit 102 is at its maximum height. Specifically, a torque is applied to the trolley unit 128 when the collection unit 102 is elevated due to the distance between the collection unit 102 and the trolley unit 128. This torque acts to pull on the vertical support members 202 where they connect to the base plate 208. In addition, the torque creates an upward force on the rear end 232 of the trolley unit 128. The angled support members 226 act to redistribute the force on the connecting points of the vertical support members 202 to the wheel units 210 near the rear end 232 of the trolley unit 128.

As FIG. 2C illustrates, each of the upper wheels 222 and lower wheels 224 in the wheel units 210 connect to the outer wheel plate 218. Further, in one embodiment consistent with the present invention, the rotational points of the wheels in the upper wheels 222 of the wheel unit 210 are offset from the lower wheels 224 of the wheel unit 210 by a distance L. The upper wheels 222 are located closer to the front end 234 of the trolley unit 128 than the lower wheels 224. By offsetting the wheels in the wheel unit 210 such that the upper wheels 222 are located closer to the front end 234 of the trolley unit 128 than the lower wheels 224, the trolley unit 128 is prevented from separating from the trolley guidance unit 130 when the collection unit 102 is elevated. Also, because either the upper or lower wheels in the wheel unit are in contact with the trolley guidance unit 130, the trolley unit 128 will remain freely movable along the trolley guidance unit 130. In one embodiment consistent with the present invention, the wheels in each wheel unit 210 are made from any material capable of rotating under a large weight without failing, including, but not limited to steel, rubber, silicon or any other suitable material.

As shown in FIGS. 2B and 2C, the vertical support members 202 are connected to the base plate 208 at one end and have an arm pivot unit 204 located on the opposing end of each of the vertical support members 202. The second extension arms 120 and upper guidance arm 122 are pivotally connected to each of the pivot arm units 204 using a rotatable device including, but not limited to a hinge, a cotter pin, a gear, etc. Each upper guidance arm 122 is rotatively coupled to the upper portion of a respective pivot arm unit 204. Further, both the second extension arm 120 and the upper guidance arm 122 rotate around the connection points 236/238 to the pivot arm units 310.

As is also shown in FIG. 2C, the lower guidance arms 124 and the extension power units 126 are each pivotally connected to the base plate 202. Each lower guidance arm 124 is rotatively connected to the base plate 208 at a rear coupling point 228 and the extension power units 126 connect the forward coupling members 230 near the front end 234 of the trolley unit 128. The lower guidance arms 124 and each extension power unit 126 is rotatively connected to the base plate 128 using a rotatable device including, but not limited to a hinge, a cotter pin, a gear, etc. The extension power unit 126 may be any device, which translates energy into vertical movement, such as, but not limited to, a hydraulic cylinder.

The function of the trolley unit 128 is to allow for the simplified storage of the collection unit 102 inside the portable container 110 and to enable the collection unit 102 to be rolled outside the container and extend to a predetermined discharge height of nine feet, seven inches or higher utilizing a standard gravity dump which is typically eight feet, nine inches or lower. This configuration provides a significant advantage over standard dump height (8'9"). In addition, this configuration allows an entire industrial vacuum system to be stored in a single container, which can be loaded onto a truck, plane or ship in a secure manner.

In one embodiment consistent with the present invention, stopping devices are provided on the trolley guidance unit 130 to prevent over travel of the wheels in either the stored or operational position. Further, locking pins are provided to prevent movement in the container during transport. The trolley unit 128 may also provide storage for the applicable discharge valve(s) and the collection unit 102.

Figure 3A:
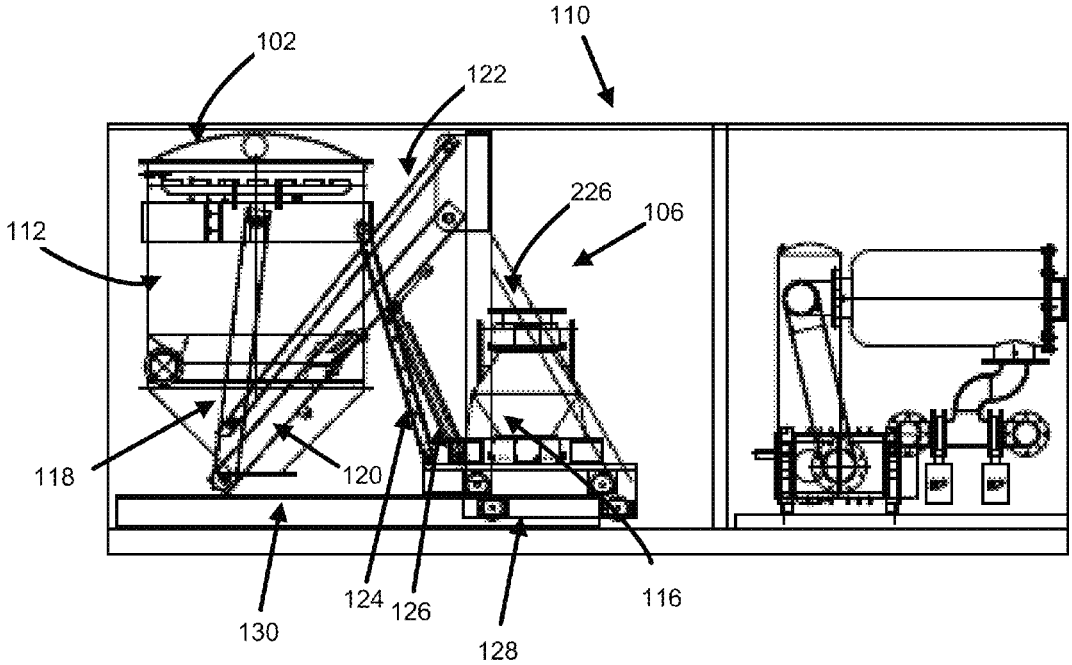
FIG. 3A depicts the vacuum system compacted into a portable container in accordance with the present invention.
Figure 3B:
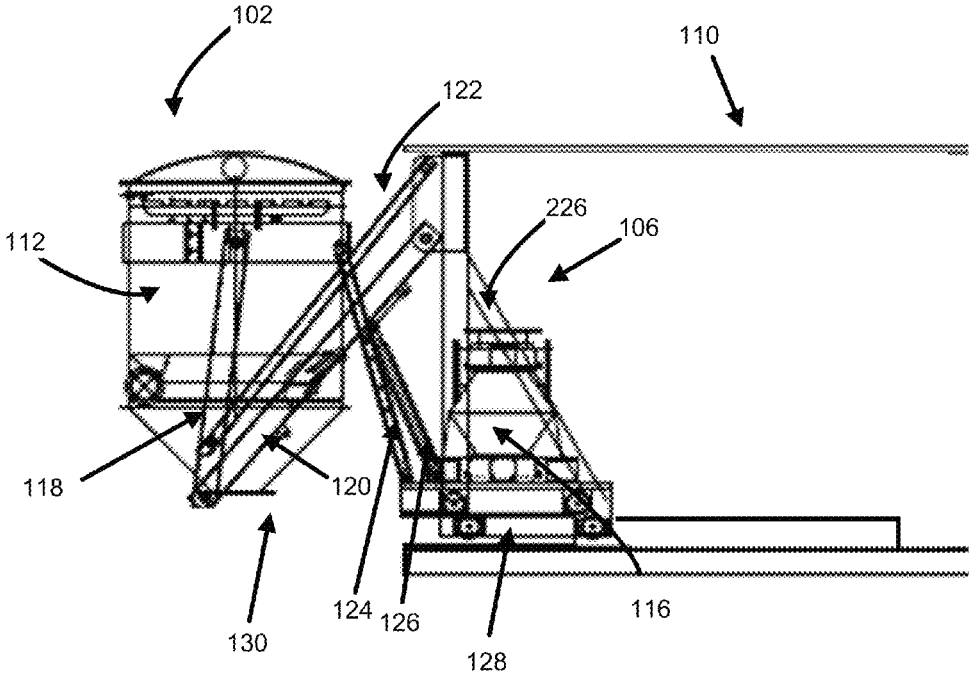
FIG. 3B depicts the vacuum system in FIG. 1A extending from the portable container in accordance with the present invention.

The operation of the unit will now be described with reference to FIGS. 1, 2 and 3. FIG. 3A depicts the vacuum system 100 compacted into a portable container 110. In one embodiment consistent with the present invention, the collection unit 102 travels forward on the trolley guidance unit 130 until the collection unit 102 is outside the portable container 110, as shown in FIG. 3B. Once the collection unit 102 is outside the front end of the portable container 110, power is provided to the power extension units 126 which causes the lower guidance arms 124 to extend upward and extend the two second extension arms 120 and two first extension arms 118 which, in turn, raise the collection unit 102 over the portable container 110 as shown in FIG. 1. While the first extension arms 118 and second extension arms 120 extend, the upper guidance arms 122 push the collection unit 102 outward in the horizontal direction away from the container 110.

When the collection unit 102 is fully extended via the extension unit 104, the trolley unit 128 remains in contact with the trolley guidance unit 130. The upper set of wheels 222 in the wheel units 210 closest to the collection unit 102 press downward on the top surface of the shelf 231 of the respective trolley guidance unit 130 as the weight of the collection unit 102 causes the front end 234 of the trolley unit 128 to push downward. Conversely, the lower wheels 224 in the rear wheel units 210 of the trolley unit 128 are in contact with the trolley guidance unit 130 preventing the rear end 232 of the trolley unit 128 from rotating clockwise. Since the trolley unit 128 has wheels above and below the trolley guidance unit 130, the trolley unit 128 is movable even when the collection canister is fully extended. Therefore, the vacuum system 100 is easily moved in and out of a portable container 110 with little effort.

Because of the above arrangement, the collection unit 102 is capable of rising to a height of at least nine feet, seven inches or more. Further additional height can be generated by bridging under the portable container 110. In another embodiment consistent with the present invention, the trolley unit 128 is moved using a powered horizontal movement device such as wench, rack and pinion gear system, motorized wheels or a horizontally positioned hydraulic cylinder.

In yet another embodiment consistent with the present invention, the vacuum system 100 is completely contained in a portable high-cube container suitable for shipping on a freightliner. The collection unit 102, extension unit 104 and transportation unit 106 are contained in a front portion of the high-cube container. The transportation guidance system 130 is coupled to the floor of the high-cube container. Further, the vacuum generation unit 108 is stored in an area separated by a steel door. When the container arrives at the desired location, the doors of the high-cube unit are opened and the trolley unit 128 is moved out via the trolley guidance unit 130. Once the collection unit 102 and the extension unit 104 are outside the high-cube container, the extension power units 126 push the extension arms outward, raising the collection unit 102 to a height of nine feet, seven inches. Once extended, the vacuum generation unit 108 is started and debris is sucked into the collection unit 102.

The present invention provides significant improvements over convention industrial vacuum systems. Since the system can be loaded into standard shipping containers, the cost of shipping the industrial vacuums is significantly reduced. Further, the present invention does not require disassembly or reassembly for shipment and operation, thereby saving labor and operational costs. Also, the present invention raises the collection unit 112 to a height of nine feet, seven inches or more which is significantly higher than conventional industrial vacuum units and enables the discharge of material from the vacuum system 100 into specialized disposal vessels. By raising the collection unit 112 to a greater height, the industrial vacuum of the present application can accommodate taller collection and disposal vessels.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

What is claimed is:

1. An industrial vacuum system, comprising:

a portable container having a bottom and an open end;

an extension unit having a first end operatively connected to the portable container and a second end that is selectively extendable away from the portable container;

a collection unit rotatively coupled to first ends of the extension unit;

a transportation unit coupling the extension unit to the container, the transportation unit having one end rotatively coupled to the end of the extension unit the transportation unit including a plurality of wheel units; and a trolley guidance unit having a rail attached to the bottom of the container and engaging the wheels of the wheel unit, wherein, the collection unit and extension unit completely move into the portable container via the transportation unit, the rails of the trolley guidance unit include a shelf having an upper surface and a lower surface, and the wheel units include at least two upper wheels in contact with the upper surface of a transportation guidance unit and at least two lower wheels in contact with the lower surface of the shelf.

2. The industrial vacuum system of claim 1, wherein the extension unit includes at least one first extension arm rotatively coupled to at least one second extension arm which is rotatively coupled to the transportation unit, at least one upper guide arm and at least one lower guide arm rotatively coupled to the transportation unit, and at least one extension power unit rotatively coupled to at least one of the second extension arms and the transportation unit.

3. The industrial vacuum system of claim 1, wherein the transportation unit is engaged to the trolley guidance units such that the transportation unit is configured to travel a predetermined distance along the trolley guidance units causing the extension unit and collection unit to move in and out of the open end of the portable container by the transportation guidance unit.

4. The industrial vacuum system of claim 3, wherein the extension unit raises the collector unit to a height of 9 feet 7 inches or higher.

5. The industrial vacuum system of claim 1, wherein the transportation guidance unit corresponds to an I shaped beam.

6. The industrial vacuum system of claim 1, further including a vacuum generation unit hydronically coupled to the collection unit which is configured to supply a negative pressure to an inside of the collection unit.

7. The industrial vacuum system of claim 1, wherein each of the wheel units include four upper wheels in contact with the upper surface of the shelf of the transportation guidance unit and four lower wheels in contact with the lower surface of the shelf of the transportation guidance unit.

8. The industrial vacuum unit of claim 1, further including a power extension unit having a first end rotatively coupled to the extension unit and having a second end rotatively coupled to the transportation unit and which is capable of rising the collection unit.

9. The industrial vacuum unit of claim 8, wherein the power extension unit and lower guide unit are rotatively connected to a base plate on a lower portion of the transportation unit, and an upper guidance arm and second extension arm are rotatively coupled to a pivot arm unit on an upper portion of the transportation unit.

10. A method of operating an industrial vacuum system including the steps of:

moving a transportation unit out of a container, the transportation unit including a plurality of wheel units which engage a trolley guidance unit which a rail attached to the bottom of the portable container;

extending an extension unit having a first end operatively connected to the portable container and a second end that is selectively extendable away from the portable container;

collecting a material using a collection unit rotatively coupled to first ends of the extension unit;

wherein, the collection unit and extension unit completely move into the portable container via the transportation unit, the rails of the trolley guidance unit include a shelf having an upper surface and a lower surface, and the wheel units include at least two upper wheels in contact with the upper surface of a transportation guidance unit and at least two lower wheels in contact with the lower surface of the shelf.

11. The method of claim 10, wherein the extension unit includes at least one first extension arm rotatively coupled to at least one second extension arm which is rotatively coupled to the transportation unit, at least one upper guide arm and at least one lower guide arm rotatively coupled to the transportation unit, and at least one extension power unit rotatively coupled to at least one of the second extension arms and the transportation unit.

12. The method of claim 10, wherein the transportation unit is engaged to the trolley guidance units such that the transportation unit is configured to travel a predetermined distance along the trolley guidance units causing the extension unit and collection unit to move in and out of the open end of the portable container by the transportation guidance unit.

13. The method of claim 10, wherein the extension unit raises the collector unit to a height of 9 feet 7 inches or higher.

14. The method of claim 13, wherein the transportation guidance unit corresponds to an I shaped beam.

15. The method of claim 10, including the step of generating vacuum via a vacuum generation unit hydronically coupled to the collection unit which is configured to supply a negative pressure to an inside of the collection unit.

16. The method of claim 10, each of the wheel units include four upper wheels in contact with the upper surface of the shelf of the transportation guidance unit and four lower wheels in contact with the lower surface of the shelf of the transportation guidance unit.

17. The method of claim 10, wherein each of the wheel units include four upper wheels in contact with the upper surface of the transportation guidance unit and four lower wheels in contact with the lower surface of the transportation guidance unit.

18. The method of claim 10, including the step of extending the extension unit using a power extension unit having a first end rotatively coupled to the extension unit and having a second end rotatively coupled to the transportation unit and which is capable of rising the collection unit.

* * * * *